US005597101A

United States Patent [19]

Barber et al.

[11] Patent Number: 5,597,101

[45] Date of Patent: Jan. 28, 1997

[54] BACKPACK FRAME/CHAIR

[75] Inventors: Ted Barber, Rte. 1, Box 811; Gary D. Avery, 407 Harper, both of Fletcher, Okla. 73541

[73] Assignees: Gary D. Avery; Ted Barber, both of Fletcher, Okla.

[21] Appl. No.: 408,218

[22] Filed: Mar. 22, 1995

[51] Int. Cl.[6] ..... A45F 4/02

[52] U.S. Cl. ..... 224/155; 224/153; 297/57

[58] Field of Search ..... 224/155, 154, 224/151, 153; 297/16.1, 16.2, 31, 42, 43, 44, 46, 47, 56, 57, 452.18

[56] References Cited

U.S. PATENT DOCUMENTS

| | | | |
|---|---|---|---|
| 2,272,307 | 2/1942 | Merrill | 297/57 |
| 2,552,883 | 5/1951 | Cable | 297/57 |
| 4,286,739 | 9/1981 | Silcott et al. | 224/156 |
| 4,300,707 | 11/1981 | Kjaer | 224/155 |
| 4,450,990 | 5/1984 | Bolstad | 224/155 |
| 4,489,866 | 12/1984 | Korte | 224/155 |
| 4,676,548 | 6/1987 | Bradbury | 297/129 |
| 4,773,574 | 9/1988 | Burgard . | |
| 5,209,381 | 5/1993 | Jay . | |
| 5,303,975 | 4/1994 | Asato | 224/155 |

*Primary Examiner*—David J. Walczak

[57] ABSTRACT

A device which may be used as a backpack frame in a first functional position and as a chair with backrest in a second functional position, while still providing ready access to the backpack, supported by the frame. The device is comprised of a generally rectangular outer leg frame, and an inner leg assembly, whose over-all width is marginally narrower than the horizontal inside dimensions of the outer leg frame side members, allowing pivotal connection of the respective frames, and having a seat frame member, pivotally supported by the upper end portions of the inner leg assembly, and guidably contained within the upper portions of the outer leg U channels, which form the outer leg frame side members.

5 Claims, 5 Drawing Sheets

BACKPACK FRAME/CHAIR

This invention relates to a combination of backpack frame and folding camp chair, with regard to compactness, versatility, lightweight, comfort, strength, and stability.

The sports of backpacking, hiking, and camping, have seen tremendous growth over the past years, with many technological improvements. Accordingly, it is an object of the present invention to provide a novel, useful accessory to these activities, along with possible military applications. As prior art has shown, there have been many attempts to implement the basic idea of converting a packframe to a chair, albeit, most are complicated, bulky affairs, and some require disassembly and re-orientation of parts to acheive the end results. Our design requires only the removal of two clevis-type pins to facilitate transformation from the pack-frame to the chair configuration, which is of a more conventional seating height an the majority of devices seen in prior art. The invention should be constructed of a light-weight material, such as an aluminum alloy, or the like, not discounting the useage of various synthetic resins and or fiber materials and is comprised of three primary elements: an outer leg assembly, an inner leg assembly, and seat frame.

The inner leg assembly moves within the outer leg assembly and is pivotably mounted thereto, which causes a scissor-like action when vaulted. While the seat frame is pivotably attached between an upper portion of the inner leg assembly, and movably guided, within U channels to a mutually parallel position referred to as the closed (pack frame) position, in the drawing.

The advantages of such a backpack frame become readily recognizable insofar as to have a backpack frame for the purpose of transporting loads, either contained within a backpack, or fastened directly to the frame.

A variety of backpacks, shoulder straps, lumbar pads, and or hip belts are compatible with this frame, plus the added option of being converted to a stable, lightweight campchair, without necessity of downloading the frame, leaving the backpack and its contents readily accessible. Other objects and advantages will become apparent in the following specification and attached drawings, wherein a preferred embodiment of the invention is illustrated.

BRIEF DESCRIPTION OF THE DRAWINGS

The accompanying drawings illustrate the best mode of implementation presently contemplated by the inventors. In the drawings.

DETAILED DESCRIPTION OF THE DRAWINGS

Figure 1:
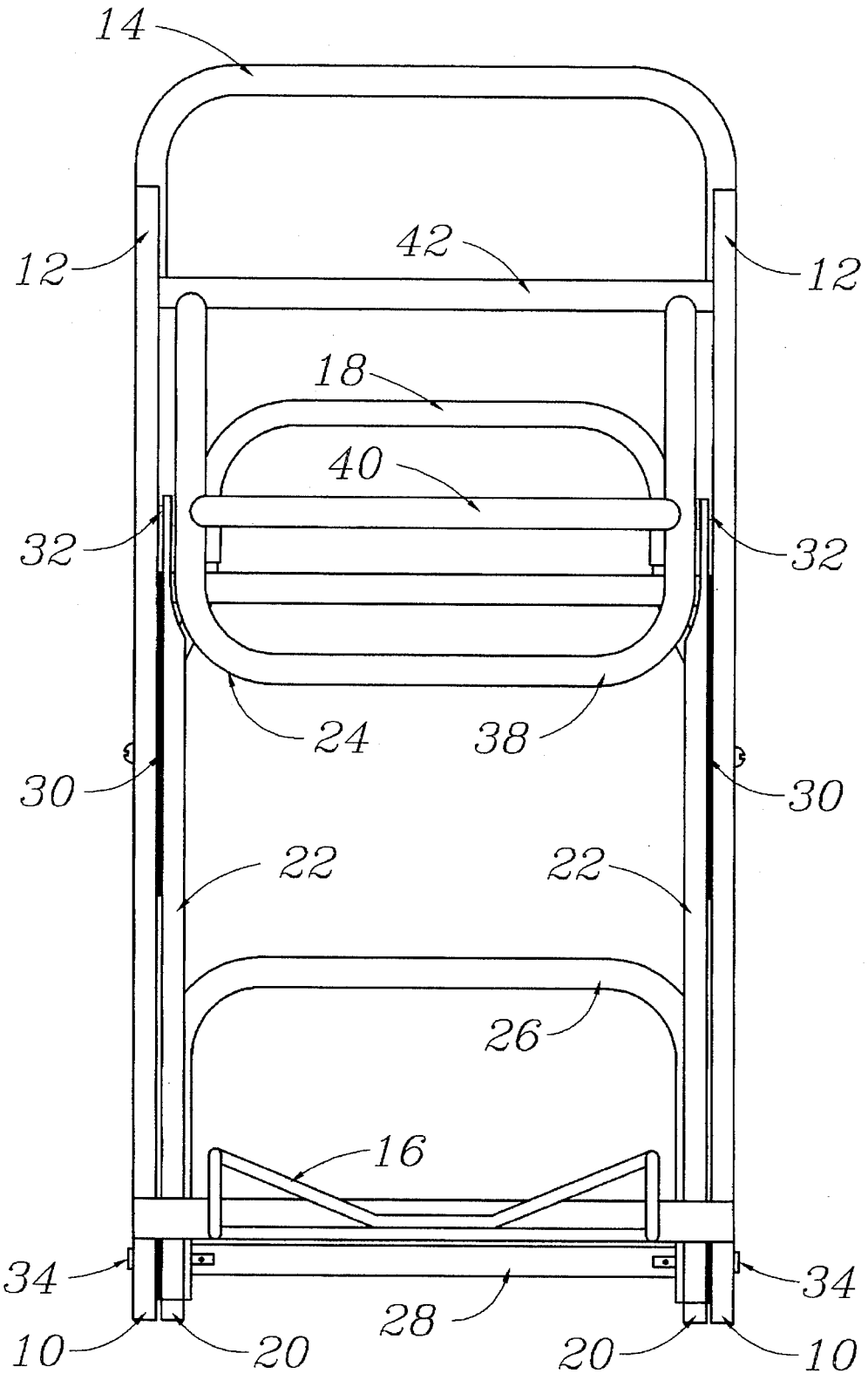
FIG. 1 shows a front elevation view of a backpack frame/chair in the closed (pack frame) position.
Figure 2:
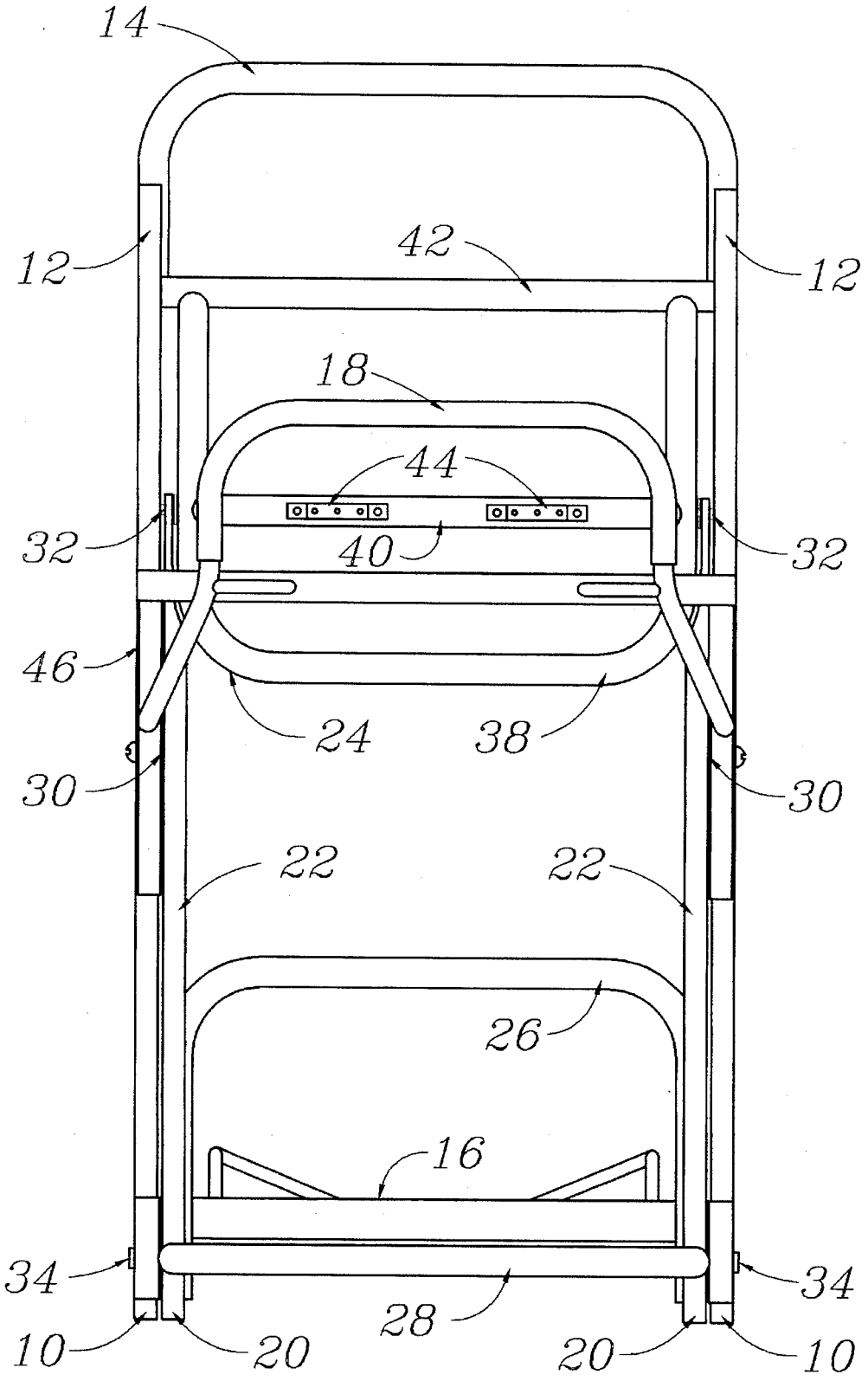
FIG. 2 shows a rear elevation view of a backpack frame/chair in the closed (pack frame) position.
Figure 3:
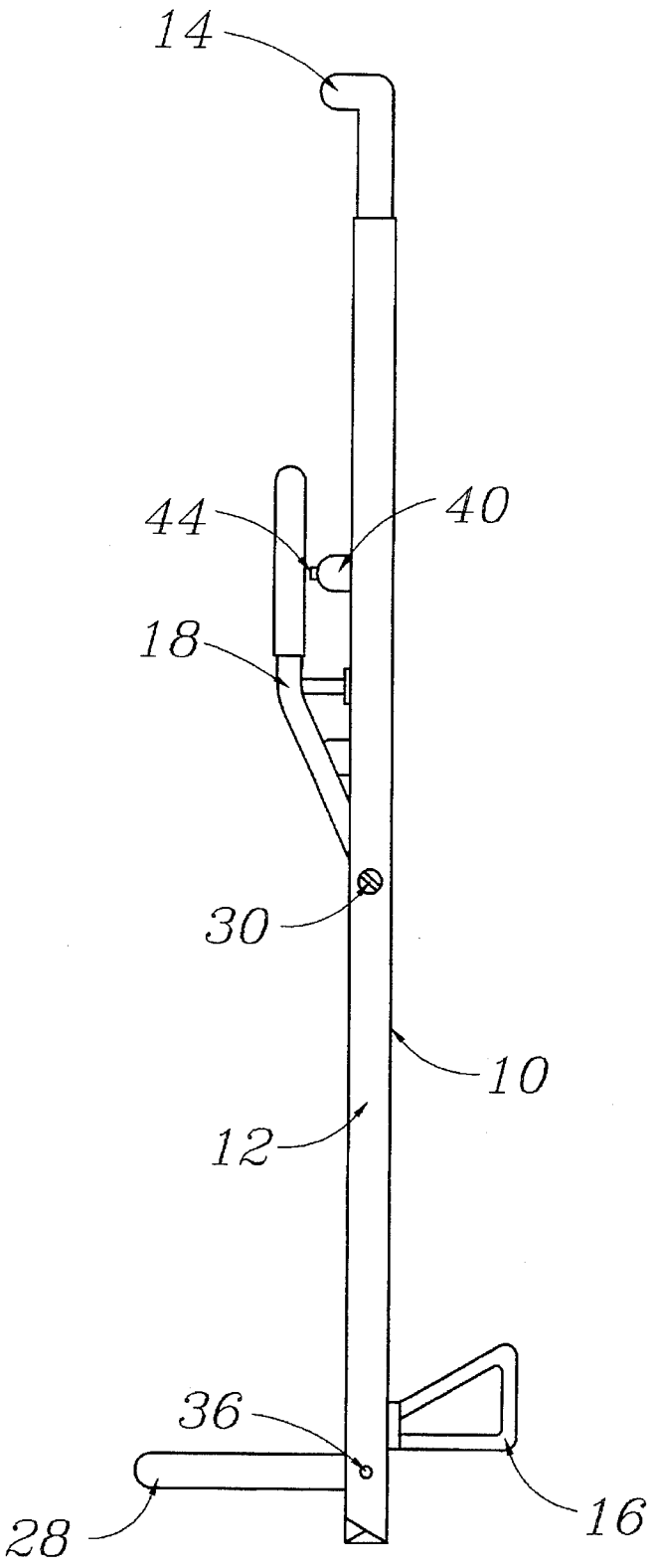
FIG. 3 shows a right side elevation view of a backpack frame/chair in the closed (pack frame) position.
Figure 4:
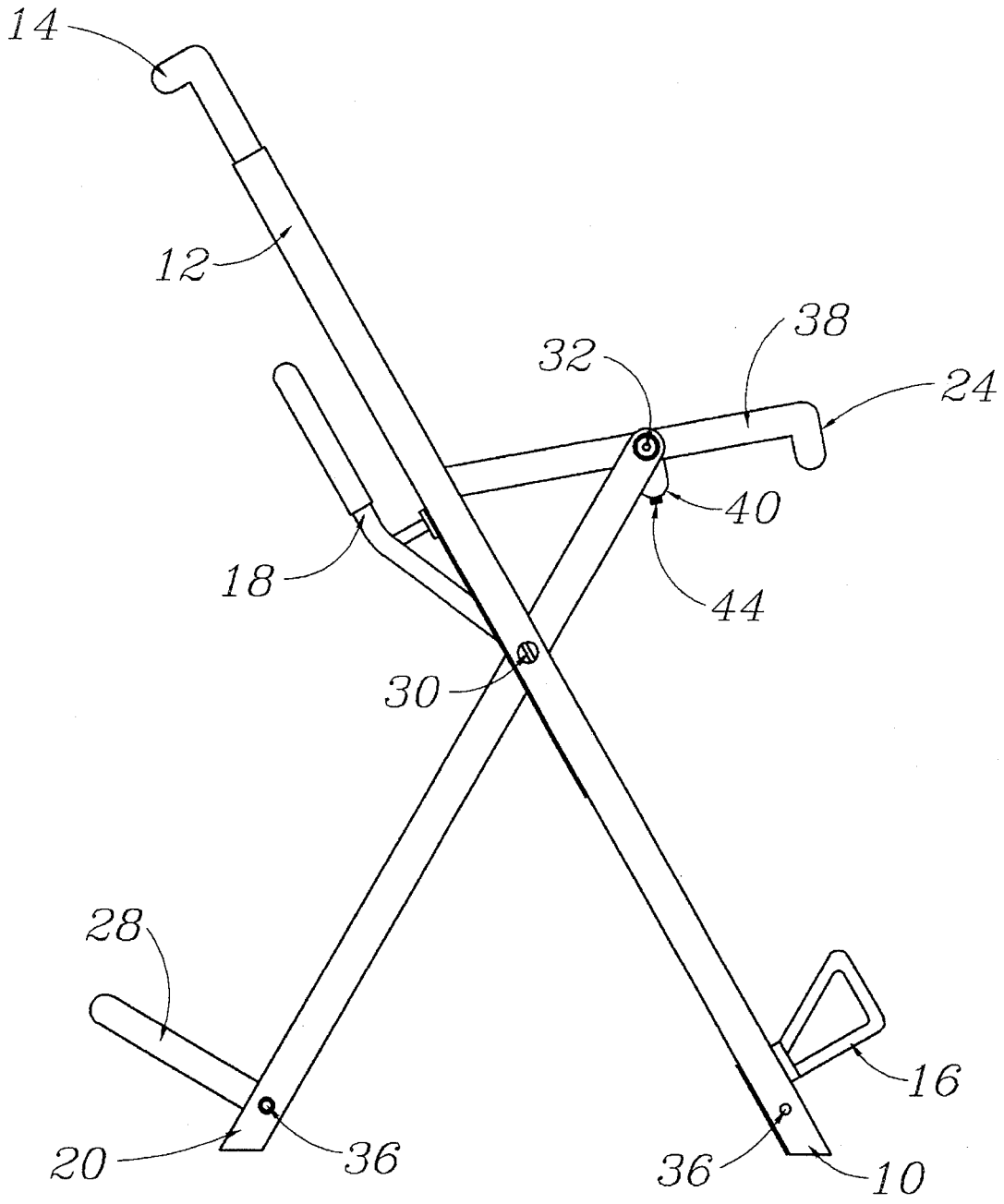
FIG. 4 shows a right side elevation view of a backpack frame/chair in the open (chair) position.

Turning to FIGS. 1–5 therein illustrated is a backpack frame/chair, comprised of an outer leg assembly 10 formed by two lengths of parallel, opposing U channels 12 separated by and connected to a generally U shaped piece of tubing 14 which rests within the above described U channels 12 at the top, in turn forming the backrest of the chair when the invention is extended to the open (chair) position, as seen in FIG. 4. The bottom of the U channels 12 are separated by and connected to a lumbar pad support bracket 16. The lumbar support bracket 16 is attached to the front sides of the U channels 12 and extending outwardly there from to provide means of attaching the lower end of shoulder straps and a lumbar pad or hip belt there to. Attached approximately midway on the back sides of the U channels 2 is a pack support bracket 18 extending outwardly and upwardly from the back of the frame as best seen in FIGS. 2, 3, and 4, providing a means to attach and support a backpack.

Figure 5:
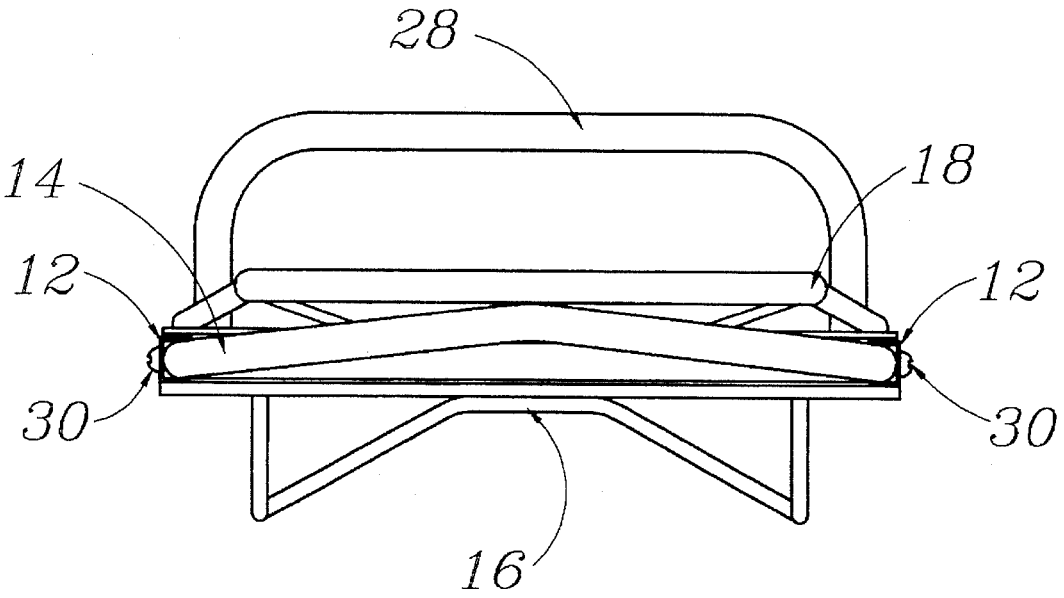
FIG. 5 shows a top plan view of a backpack frame/chair in the closed (pack frame) position, wherein the bottom of the illustration in FIG. 5 is the front side of the frame.

An inner leg assembly 20 is formed by two lengths of parallel, opposing U channels 22 separated by and pivotably attached at their upper ends 32, to the seat frame 24, as best seen in FIGS. 1 and 4. Attached within the U channels 22 at the lower end of the inner leg assembly 20, is a generally U shaped piece of tubing 26 keeping the channels 22 separated and aiding in torsional stability for the invention when extended to the open (chair) position. A cargo shelf 28, is again a generally U shaped piece of tubing, attached to the back sides of the U channels 22, extending outwardly from the back of the frame providing additional support for various loads or backpacks when the invention is in the closed (pack frame) position as best seen in FIGS. 3 and 5.

The entire inner leg assembly 20 moves within the outer leg assembly 10 and is pivotably attached at 30 to the outer leg assembly 10 affording a scissor like action when vaulted as seen in FIG. 4. When the outer and inner leg asemblies 10 and 20 are in the closed (pack frame) position, as seen in FIGS. 1, 2, 3, and 5, the two assemblies are locked together via clevis pins 34 as seen in FIGS. 1 and 2 inserted through holes 36 transversely drilled through the lower end of both leg assemblies 10 and 20 as seen in FIGS. 3 and 4. The seat frame 24, constructed of tubing, is formed by a generally U shaped piece 38, with a mid-sectional transverse brace 42, that extends slightly beyond the outside edges of the seat frame tubing 38 as to form guides which ride within the outer leg assembly U channels 12 as best seen in FIG. 1. Once the invention is extended to the open (chair) position, FIG. 4, further downward sliding movement of the rear of the seat frame 24, within the outer leg U channels 12 is prohibited by a stop 46 (not readily discernible from the views in the drawings) attached to the insides of the outer leg U channels 12, and thus limiting the scissor action of the pivotally interconnected leg frame assemblies 10 and 20.

Shoulder strap guides 44 are attached to the back of the seat frame brace 40 (FIGS. 2, 3, and 4), to prevent lateral shifting of the upper ends of shoulder straps attached to this brace when the invention is in the closed (pack frame) position. While the invention is described in connection with a certain preferred embodiment, it will be apparent to those of ordinary skill in the art, that many modifications may be made thereof, within the scopy of the invention. It is to be understood that it is not intended to limit the invention to that particular embodiment. Rather it is intended to cover all alternatives, modifications, and equivalents as may be included within the spirit and scope of the invention as described by the appended claims.

What is claimed is:

1. A backpack frame convertible to a chair comprised of:

an outer leg frame comprised of two substantially parallel opposing U-shaped channels joined at upper ends thereof by an extension brace;

an inner leg frame comprised of two opposing substantially parallel support portions joined at lower ends thereof by a lower brace member wherein central portions of said support portions of said inner leg frame are pivotally connected to respective central portions of said opposing U-shaped channels of said outer leg frame by a pair of first pivot connections;

a seat frame comprised of opposed side braces, a rear brace connecting ends of said side braces, a front brace connecting opposite ends of said side braces and a central brace connecting central portions of said side braces wherein said central portions of said side braces are respectively pivotally connected to upper ends of said support portions of said inner leg frame by a pair of second pivot connections and said seat frame rear brace includes protruding extensions on opposite ends thereof which are respectively slidingly engaged in said opposed U-shaped channels of said outer leg frame;

a plurality of shoulder strap guides positioned on said seat frame central brace and adapted to receive shoulder straps in order to enable a user to wear the backpack frame and a pack support bracket attached to said central portions of said opposing U-shaped channels of said outer leg frame and adapted to support a pack thereon whereby said frame folds from a folded backpack frame position wherein the inner leg frame, the outer leg frame and the seat frame are disposed in a substantially vertical orientation such that the frame can be carried upon a user's back to an unfolded chair position wherein the inner leg frame is pivoted with respect to the outer leg frame about said first pivot connections, said seat frame side braces are pivoted with respect to said inner leg frame at said second pivot connections and said protruding extensions of said seat frame are slid along respective U-shaped channels of said outer leg frame such that a lower portion of said outer leg frame forms front legs of said chair, a lower portion of said inner leg frame forms the rear legs of said chair, an upper portion of said outer leg frame forms the back rest of said chair and said seat frame forms a seat portion of said chair.

2. The backpack frame of claim 1 wherein a cargo shelf is mounted to said lower end of said inner leg frame.

3. The backpack frame of claim 1 wherein a lumbar pad support member is mounted to said lower end of said outer leg frame and adapted to support a pad to be held against a user's back when said frame is worn on a user' back.

4. The backpack frame of claim 1 wherein when said frame is in said folded position, aligned holes in said lower ends of said inner and outer leg frames are adapted to receive a clevis pin in order to lock said frame in said folded position.

5. The backpack frame of claim 1 wherein a stop means is provided on said outer leg frame to limit the sliding of said protruding portions of said seat frame.

* * * * *